United States Patent [19]

Kondo et al.

[11] 4,405,845

[45] Sep. 20, 1983

[54] PUSH-BUTTON SWITCH

[75] Inventors: Shiro Kondo, Furukawa; Ken Mizuta, Miyagi, both of Japan

[73] Assignee: Alps Electric Co., Ltd., Tokyo, Japan

[21] Appl. No.: 318,422

[22] Filed: Nov. 5, 1981

[30] Foreign Application Priority Data

Nov. 8, 1980 [JP] Japan ..... 55-159695[U]

[51] Int. Cl.[3] ..... H01H 5/18; H01H 13/52

[52] U.S. Cl. ..... 200/67 DB; 200/159 A; 200/283

[58] Field of Search ..... 200/159 A, 283, 67 DA, 200/67 DB

[56] References Cited

U.S. PATENT DOCUMENTS

| | | | |
|---|---|---|---|
| 1,215,665 | 2/1917 | Landis | 200/67 DB |
| 2,923,787 | 2/1960 | Nelson | 200/159 A |
| 3,899,648 | 8/1975 | Murata | 200/67 DB |
| 3,996,429 | 12/1976 | Chu et al. | 200/67 DB |
| 4,002,871 | 1/1977 | Sims, Jr. | 200/159 A |
| 4,118,609 | 10/1978 | Schadow et al. | 200/159 A |
| 4,190,751 | 2/1980 | Roth et al. | 200/159 A |

FOREIGN PATENT DOCUMENTS

| | | | |
|---|---|---|---|
| 2812230 | 10/1978 | Fed. Rep. of Germany | 200/159 A |

*Primary Examiner*—John W. Shepperd

*Attorney, Agent, or Firm*—Guy W. Shoup; Gerard F. Dunne

[57] ABSTRACT

A momentary push-button switch wherein a movable contact piece is made of an elastic and conductive metal sheet by incurvating the latter and providing a pair of coupling portions on its sides in parallel with the depressing direction of the switch, and the coupling portions are bent to increase their rigidities against a pressing force. A switching tactility based on the inversion of the movable contact is clearly developed.

1 Claim, 6 Drawing Figures

PUSH-BUTTON SWITCH

BACKGROUND OF THE INVENTION

The present invention relates to a push-button switch. More particularly, it relates to a push-button switch which can be operated momentarily and yet can have a reduced thickness and a good tactile feel during its operation.

Heretofore, various structures have been proposed and put into practical use for switches which act momentarily to provide a transient pulse or the like. Such a known switch is shown in FIG. 1 wherein a contact portion 11*a* of a movable contact piece 11 obtained by forming a highly resilient and conductive thin metal plate into a bulbous shape, and stationary contact portions 12*a* and 13*a* of respective stationary contact pieces 12 and 13 are disposed in a casing 14 in a manner to oppose to each other. The movable contact piece 11 is inverted by depressing a push button 15, to bring the contact portion 11*a* of the movable contact piece 11 into engagement with the stationary contact portions 12*a* and 13*a*. Thus, a switching circuit is turned "on." Upon releasing the force depressing the push button 15, the push button 15 and the contact portion 11*a* are returned to their initial positions by the spring force of the movable contact piece 11, so that the switching circuit can quickly be turned "off."

In such momentary switches, substantially the central part of the movable contact piece 11 is depressed in the thickness direction of the contact piece. Therefore, the occupying space of the switch is liable to become large. This has formed an obstacle to the miniaturization of equipment. This disadvantage becomes more conspicuous as the number of the switches to be used increases as, for example, when switches are used to control multifunction; operation of equipment.

On account of the structure of the prior-art momentary switch wherein the movable contact piece is depressed in the direction of the thickness of the switch, the inverting operation of the inverting portion of the switch is not transmitted to the finger. This has led to the disadvantage that the feel of operation of the switch is feeble.

SUMMARY OF THE INVENTION

It is accordingly an object of the present invention to provide a push-button switch which can be reduced in thickness can afford a light switching tactility and which exhibits a high reliability.

In one aspect of performance of the present invention, a push-button switch comprises a movable contact piece formed of a resilient and conductive material and having a contact portion centrally provided with tongues, coupling portions formed in parallel on respective sides of said contact portion and preferably bent to increase rigidity, and arms connecting respective end parts of said coupling portions. A casing which has an engaging portion to engage one of said arms and stationary contacts fixed in said casing are also provided. A slider which has a push-button portion and an engaging portion to engage the other arm and is installed on said casing in a manner permitting reciprocal movement therewithin. The arms of said movable contact piece are held in engagement with the corresponding engaging portions, and contact portion is held in opposition to the stationary contacts, whereby the coupling portions of said movable contact piece can be inverted to control electrical conduction between said contact portion and said stationary contacts upon pressing the push-button portion of the slider.

PREFERRED EMBODIMENT OF THE INVENTION

Hereunder, an embodiment of the present invention will be described in detail with reference to the drawings.

Figure 1:
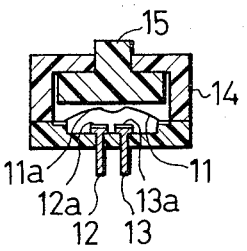
Fig.1 PRIOR ART
FIG. 1 is a sectional view of a prior-art push-button switch.
Figure 3A:
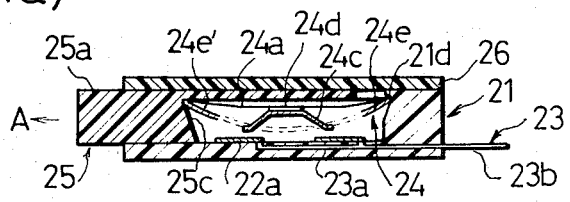
Figure 3B:
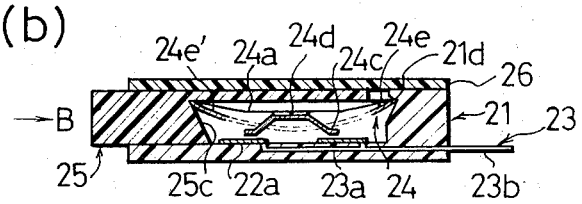
Figure 3C:
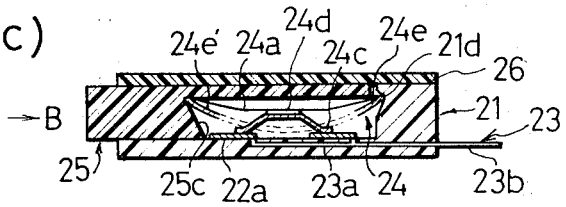
Figure 3D:
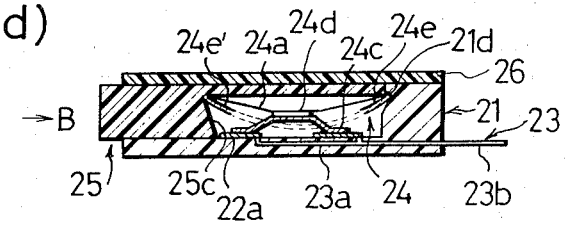
Figure 2:
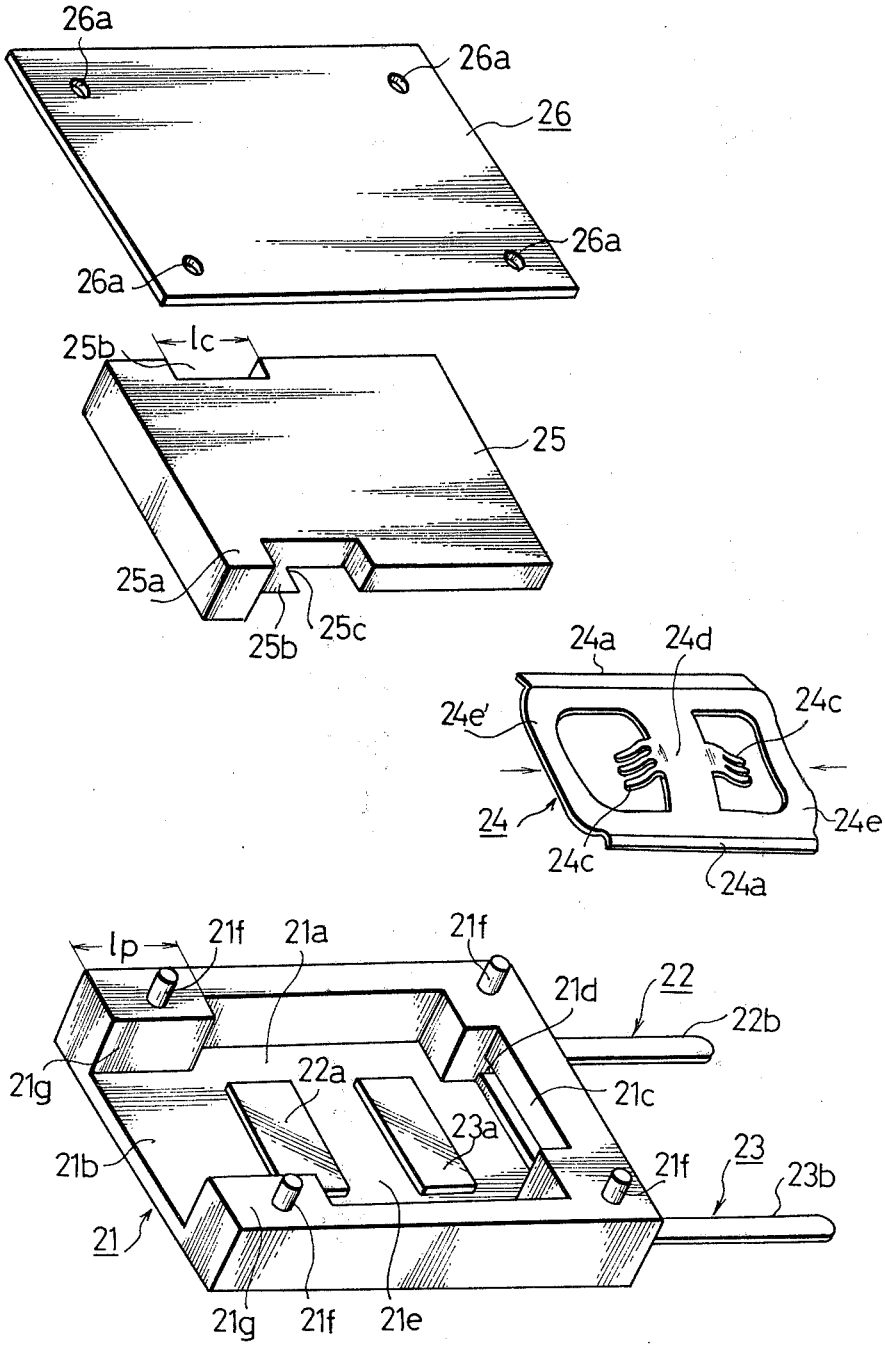
FIG. 2 is an exploded perspective view of a push-button switch according to the present invention, and FIGS. 3(*a*) to 3(*d*) are sectional views for explaining the operation of the push-button switch according to the present invention.

FIG. 2 is an exploded perspective view of a push-button switch according to the present invention, while FIGS. 3(*a*) to 3(*d*) are sectional views for explaining the operation of the push-button switch.

In the figures, numeral 21 designates a casing which is obtained by insert-molding a synthetic resin. The casing 21 includes a recess 21*a* which has an opening 21*b* fromed in one side. Opposite the opening 21*b* is a side wall 21*c* having a groove 21*d* formed into a V-shape, and the recess 21*a* includes a bottom portion 21*e* having stationary contacts 22 and 23 fixed thereto. Corner portions of the casing 21 include upstanding post portions serving to mount a cover to be described later, and protuberances 21*g* and 21*g* extending inwardly. The stationary contact pieces 22 and 23 have contact portions 22*a* and 23*a* exposed on the surface of the bottom portion 21*e* of the casing 21, and external connection terminals 22*b* and 23*b* are connected electrically to the respective contact portions 22*a* and 23*a*. The stationary contact pieces 22 and 23 are fixed to the casing simultaneously with the molding of the casing by disposing them in a metal mold and thereafter insert-molding the synthetic resin. Numeral 24 indicates a movable contact piece which is unitarily formed by punching a highly resilient and conductive metal sheet. The movable contact piece consists of a movable contact portion 24*d* having an upwardly bowed central portion of small width which is centrally provided with tongues 24*c* and 24*c* each being divided into a plurality of parts extending downwardly. The movable contact piece 24 further includes a pair of coupling portions 24*a* which are formed in parallel on respective sides of the contact portion 24*d*, and arcuate arms 24*e* and 24*e*′ extending between respective end parts of the coupling portions 24*a*. The arms 24*e* and 24*e*′ are bowed downwardly as to project in the same direction as the tongues 24*c* of the contact portion 24*d*. The coupling portions 24*a* and 24*a* are bent along their length to form an inverted V-shape in section in order to increase somewhat their rigidity in the directions of the arrows; the coupling portions 24*a* are adapted to be inverted so as to project in the downward direction by applying forces in the directions of the arrows to the arms 24*e* and 24*e*′. Numeral 25 indicates a slider, which includes a push-button portion 25*a*, notches 25*b* to engage the respective protuberances 21*g* and 21*g* provided in the casing 21, and a depending flange portion 25*c*. The length $l_c$ of the cuts or notches 25*b* is made greater than the length $l_p$ of the protuberances 21*g*. Thus, the slider 25 can advance or retreat within the recess 21*a* of the casing 21 to the amount of ($l_c$–$l_p$). One arm 24*e'* of the movable contact piece 24 engages the flange portion 25*c*. The cover 26 for overlaying the top of the casing 21 is formed at its four corners with holes 26*a*, into which the post portions 21*f* formed in the casing 21 are inserted. The cover 26 can be fastened to the casing 21 in such a way that the upper part of the casing 21 is coated with a binder in advance and that the cover 26 is placed on the casing 21 with the post portions 21*f* inserted in the holes 26*a*.

Now, the assemblage of the push-button switch according to the present invention will be described.

First, the casing 21 is molded by insert-molding, and the stationary contact pieces 22 and 23 are simultaneously fastened unitarily with the casing.

Subsequently, one arm 24*e* of the movable contact piece 24 is engaged with and assembled in the groove 21*d* formed in the casing 21.

Thereafter, the slider 25 is arranged in the opening 21*b* of the recess 21*a* of the casing 21, and the other arm 24*e'* of the movable contact piece 24 is brought into engagement with the flange portion 25*c* of the slider 25. Under this state, the slider 25 is somewhat pushed in the depressing direction of the movable contact piece 24, to bring the protuberances 21*g* of the case 21 into engagement with the respective notches 25*b*. Thus, the central part of the movable contact portion 24*d* comes into close contact with the rear surface of the slider 25. The slider 25 is normally urged outwards by the spring force of the movable contact piece 24, and the push-button portion 25*a* protrudes from the casing 21.

Subsequently, the position portions 21*f* of the casing 21 are inserted through the holes 26*a* the cover 26, to place the cover 26 on the top surface of the casing 21 and to fix it with binder. Then, the push-button switch according to the present invention is completed (FIG. 3(*a*)).

Now, the operation of the push-button switch according to the present invention will be described with reference to FIGS. 3(*a*)–3(*d*).

In the unactivated state of the push-button portion 25*a* (FIG. 3(*a*)), the arms 24*e* and 24*e'* of the movable contact piece 24 are respectively held in engagement with the groove 21*d* of the casing 21 and the flange portion 25*c* of the slider 25, and hence, the slider 25 is urged outwards (in the direction of arrow A). For this reason, the slider 25 lies in its leftmost position, and the movable contact portion 24*d* is out of engagement with the stationary contact portions 22*a* and 23*a* of the respective stationary contact pieces 22 and 23, i.e. the "switch is "off".

When, under this state, the push-button portion 25*a* is pressed inwardly in the direction of arrow B, the arms 24*e* and 24*e'* of the movable contact piece 24 are curved downwardly.

When the push-button portion 25*a* is further pressed in the direction of arrow B, the coupling portions 24*a* of the movable contact piece 24 are momentarily inverted downwardly after overcoming the increased rigidity afforded by their V-shape cross section.

When the pressing force has been accumulated to exceed a certain limit value, the movable contact piece is incurvated substantially centrally of the coupling portions 24*a* and 24*a* and is suddenly inverted. Concurrently with the inverting operation, the movable contact portion 24*d* is also suddenly moved downwardly. The tongues 24*c* of the movable contact portion 24*d* are respectively brought into pressed contact with the stationary contact portions 22*a* and 23*a* by the repulsive force of the movable contact piece 24, so that the switch is turned "on" (FIG. 3(*c*)).

When, under this state, the push-button portion 25*a* is further pressed, the tongues 24*c* of the movable contact portion 24*d* slide in pressed touch with the stationary contact portions 22*a* and 23*a* while being deformed up to their elastic limit as shown in FIG. 3(*d*). The movable range of the slider 25 can be adjusted by varying the respective lengths $l_c$ and $l_p$ of the cuts 25*b*, and the protuberances 21*g*.

When the pressing force is released from the push-button portion 25*a*, the state of FIG. 3(*a*) is restored in the reverse order to the foregoing steps, and the switch turns "off."

As set forth above, according to the present invention, a movable contact piece is made of a highly resilient and conductive metal sheet by curving it into a bulge shape or substantially inverted-V shape and by providing a pair of coupling portions on its respective sides in parallel with a pressing direction of the push button of the switch, and the coupling portions are bent to increase their rigidities against the pressing force. Since the pressing force of a pressing operation is once accumulated in this manner, a switching tactility based on an inverting action can be attained more clearly. Moreover, since the movable contact piece is inverted at a stroke by the accumulated depressing force, the parting time of contact portions can be made still shorter than in the prior art. Thus, electrical damages due to arcs etc. developing at the contact of the contact portions are relieved, and a thin push-button switch with a contact structure capable of keeping a stable contact to assure a high reliability can be provided.

We claim:

1. A push-button switch comprising a movable contact piece formed of a resilient and conductive material, said contact piece having a contact portion provided centrally, tongue portions extending away from said contact portion, parallel coupling portions formed on respective sides of said contact portion, and arm portions connecting respective end parts of said coupling portions; a casing having an engaging portion adapted to engage one of said arm portions, stationary contacts fixed in said casing; a slider having a push button portion and an engaging portion adapted to engage the other of said arm portions; and means holding said slider for reciprocal movement in a first direction within said casing so that said coupling portions of said movable contact piece can be inverted in a second direction to bring said tongue portions into engagement with said stationary contacts and control electrical conduction between said contact portion and said stationary contacts upon pressing said push-button portion in said first direction, said coupling portions extending parallel to the direction of movement of said slider and being bent along their longitudinal direction to form a generally V-shaped section.

* * * * *